US008266731B2

(12) United States Patent
Marra

(10) Patent No.: US 8,266,731 B2
(45) Date of Patent: Sep. 18, 2012

(54) TOILET SEAT WITH URINE DEFLECTOR

(75) Inventor: Patrick K. Marra, Morgantown, PA (US)

(73) Assignee: Takara Belmont Corporation, Osaka (JP)

( * ) Notice: Subject to any disclaimer, the term of this patent is extended or adjusted under 35 U.S.C. 154(b) by 1337 days.

(21) Appl. No.: 11/682,809

(22) Filed: Mar. 6, 2007

(65) Prior Publication Data

US 2007/0204391 A1 Sep. 6, 2007

Related U.S. Application Data

(60) Provisional application No. 60/779,573, filed on Mar. 6, 2006.

(51) Int. Cl.
*E03D 9/00* (2006.01)
*F15D 1/00* (2006.01)
*A47K 13/14* (2006.01)

(52) U.S. Cl. ..... 4/300.3; 4/245.2; 4/245.5; 4/DIG. 5

(58) Field of Classification Search ..... 4/243.2, 4/245.2, 245.5, 300.3, DIG. 5
See application file for complete search history.

(56) References Cited

U.S. PATENT DOCUMENTS

| | | | | |
|---|---|---|---|---|
| 936,714 | A * | 10/1909 | Gunton | 4/237 |
| 964,533 | A * | 7/1910 | McDonald | 4/237 |
| 3,931,649 | A * | 1/1976 | Jankowski | 4/300.3 |
| 4,062,070 | A | 12/1977 | Prince | |
| 4,709,426 | A | 12/1987 | Godwin, Jr. | |
| 5,625,905 | A * | 5/1997 | Woods | 4/300.3 |
| 5,732,416 | A * | 3/1998 | Albert | 4/300.3 |
| 5,887,291 | A * | 3/1999 | Bellizzi | 4/245.5 |
| 6,055,681 | A | 5/2000 | Lyons | |
| 6,305,034 | B1 | 10/2001 | Perez Urrutia | |
| 6,408,447 | B1 | 6/2002 | Burbank et al. | |
| 6,550,075 | B1 | 4/2003 | Brannon, III | |
| 2002/0194672 | A1 | 12/2002 | Devereux | |
| 2006/0096015 | A1 * | 5/2006 | Lim | 4/300.3 |
| 2007/0056086 | A1 * | 3/2007 | Raviendran | 4/300.3 |

* cited by examiner

*Primary Examiner* — Len Tran
*Assistant Examiner* — Ryan Reis
(74) *Attorney, Agent, or Firm* — Lackenbach Siegel LLP; Myron Greenspan

(57) ABSTRACT

A toilet seat for use with a Western-style toilet bowl. The seat has a generally-oval, endless base that compliments the shape of the toilet bowl rim. A deflector is fixed to the bottom surface of the base and extends downwardly adjacent the inside surface of the bowl rim. The deflector covers the interior gap between the bottom of the seat and the top of the bowl rim.

11 Claims, 5 Drawing Sheets

TOILET SEAT WITH URINE DEFLECTOR

FIELD OF THE INVENTION

The present invention relates to a toilet seat with a deflector that prevents urine from splashing, squirting or leaking between the rim of the toilet bowl and the toilet seat.

BACKGROUND OF THE INVENTION

For most people, the task of cleaning a toilet is a time-consuming and undesirable chore. In order to reduce cleaning frequency of the inside, i.e., water-containing portion of the bowl, it is known to provide disks or cartridges that time-release detergents or disinfectants into the water stream of the tank. However, because the rim and exterior of the bowl are not rinsed with each flush of the toilet, the exterior, and more particularly the rim, arguably become the dirtiest part of the toilet and require constant cleaning.

The sources of contamination to the exterior and rim of the toilet bowl are well known. For example, when men urinate from the standing position, misdirected and splashed urine builds up on the rim. To maximize urine containment within the bowl, men may elect to urinate from the sitting position. However, if the man does not properly direct his urine stream, such as if he has a partial erection, urine still splashes, squirts or leaks between the toilet bowl and the seat, thereby contaminating the rim and bowl exterior. Such misdirection can occur in a woman's urine stream as well. Therefore, it would be desirable to provide a device that prevents urine from splashing, squirting or leaking between the rim of the toilet bowl and the toilet seat when men and women urinate from the sitting position.

SUMMARY OF THE INVENTION

Figure 1:
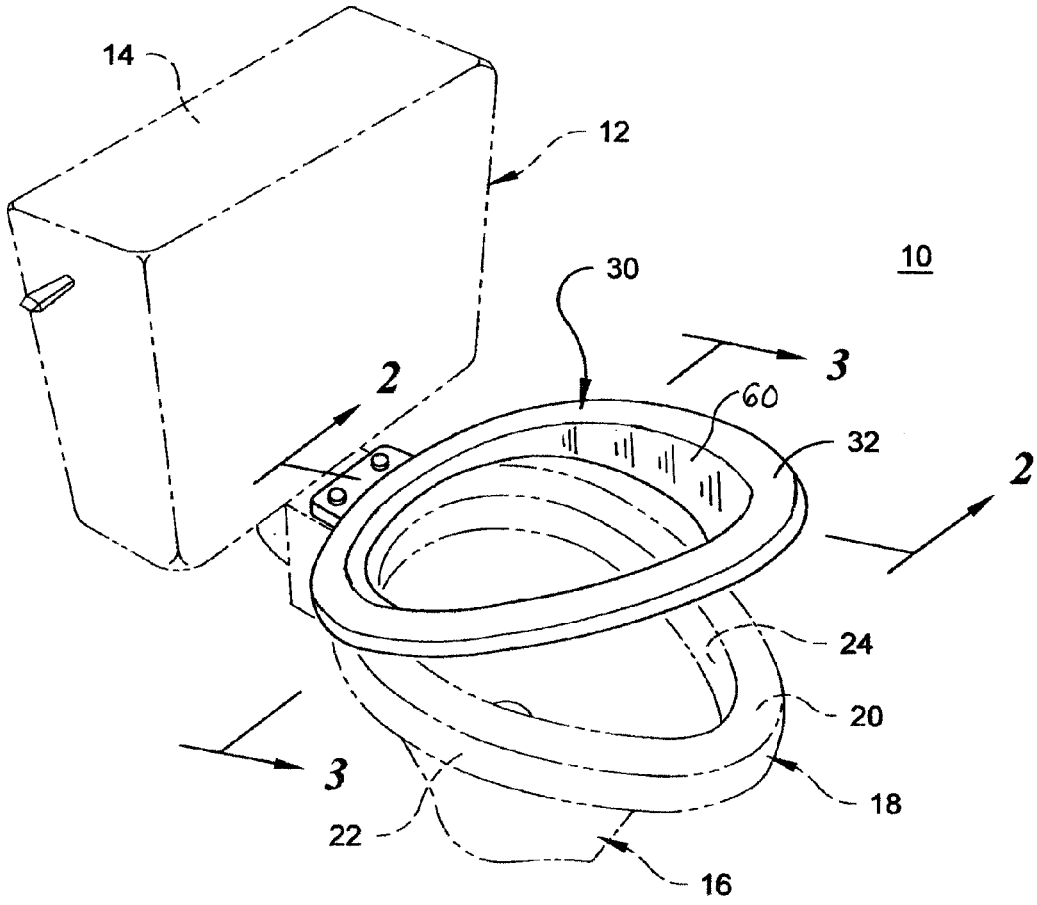
FIG. 1 is a perspective of a seat installed on a toilet in accordance with a first embodiment of the invention.

The invention comprises a toilet seat that prevents urine from splashing, squirting or leaking between the rim of the toilet bowl and the toilet seat when men and women urinate from the sitting position. In preferred embodiments, the toilet seat is used with a Western-style toilet bowl having a bowl rim width BRW, a bowl rim height BRH, a bowl inner diameter BID, and a bowl outer diameter BOD.

The seat has a generally-oval, endless base that compliments the shape of the toilet bowl rim. The base has a top surface, bottom surface, opposed front and back sections, opposed side sections, an outer periphery, and an inner periphery having a seat inner diameter SID smaller than BID. A deflector is fixed to the bottom surface of the base and extends downwardly adjacent the inside surface of the bowl rim. The deflector covers the interior gap between the bottom of the seat and the top of the bowl rim so that urine can not squirt, splash or leak onto the bowl rim and down the outside of the bowl. The seat has a hinge at the back section for pivotally attaching the seat to the bowl, and a plurality of legs on the bottom surface of the seat.

In one embodiment, the deflector extends downwardly around the entire periphery of the base and the depth of the deflector is constant along the periphery. In this embodiment, the depth of the deflector may be great enough so that the deflector extends downwardly below the bottom of the bowl rim.

In another embodiment, the deflector has a maximum depth at the front section and tapers to a minimum height at the back section. In this embodiment, the depth of at least a portion of the deflector may be great enough so that the deflector portion extends downwardly below the bottom of the bowl rim.

The base preferably has a width greater than BRW. The deflector may extend from the inner periphery of the base and the deflector outer diameter DOD may be equal to the corresponding SID. Alternatively, the deflector extends from the bottom surface of the base and the deflector outer diameter DOD is greater than the corresponding SID. The deflector may extend downwardly and radially inwardly, or parallel to the inside surface of the rim, or radially outwardly.

In another embodiment, the deflector includes a spout formed proximate the back section. The spout extends downwardly and radially outwardly so that liquid does not pool in the deflector when the seat is lifted to the vertical position.

DETAILED DESCRIPTION OF PREFERRED EMBODIMENTS

For the purpose of illustrating the invention, there is shown in the accompanying drawings several embodiments of the invention. However, it should be understood by those of ordinary skill in the art that the invention is not limited to the precise arrangements and instrumentalities shown therein and described below. The invention is capable of other embodiments and of being practiced and carried out in various ways. Also, it is to be understood that the phraseology and terminology employed herein are for the purpose of description and should not be regarded as limiting.

The toilet seat in accordance with preferred embodiments of the present invention is illustrated in FIGS. 1-7 wherein like reference numerals are used throughout to designate like elements.

Figure 2:
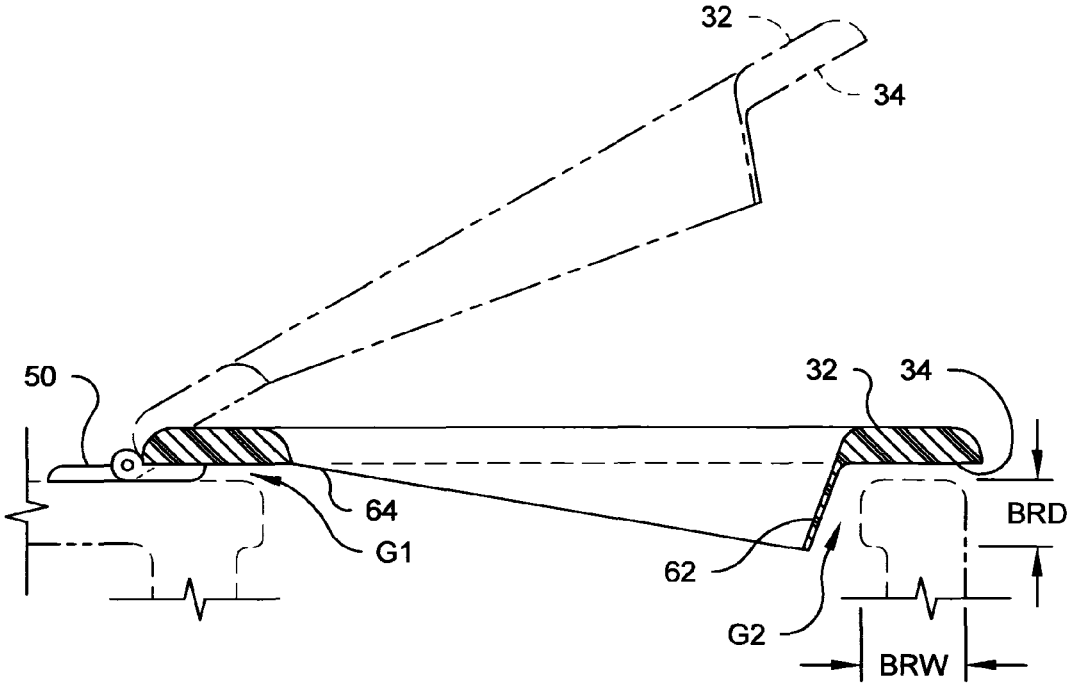
FIG. 2 is a sectional view taken along lines 2-2 of FIG. 1.
Figure 3:
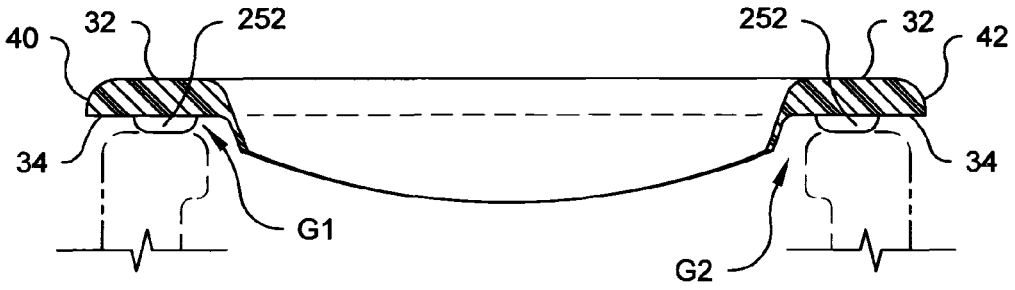
FIG. 3 is a sectional view taken along lines 3-3 of FIG. 1.
Figure 4:
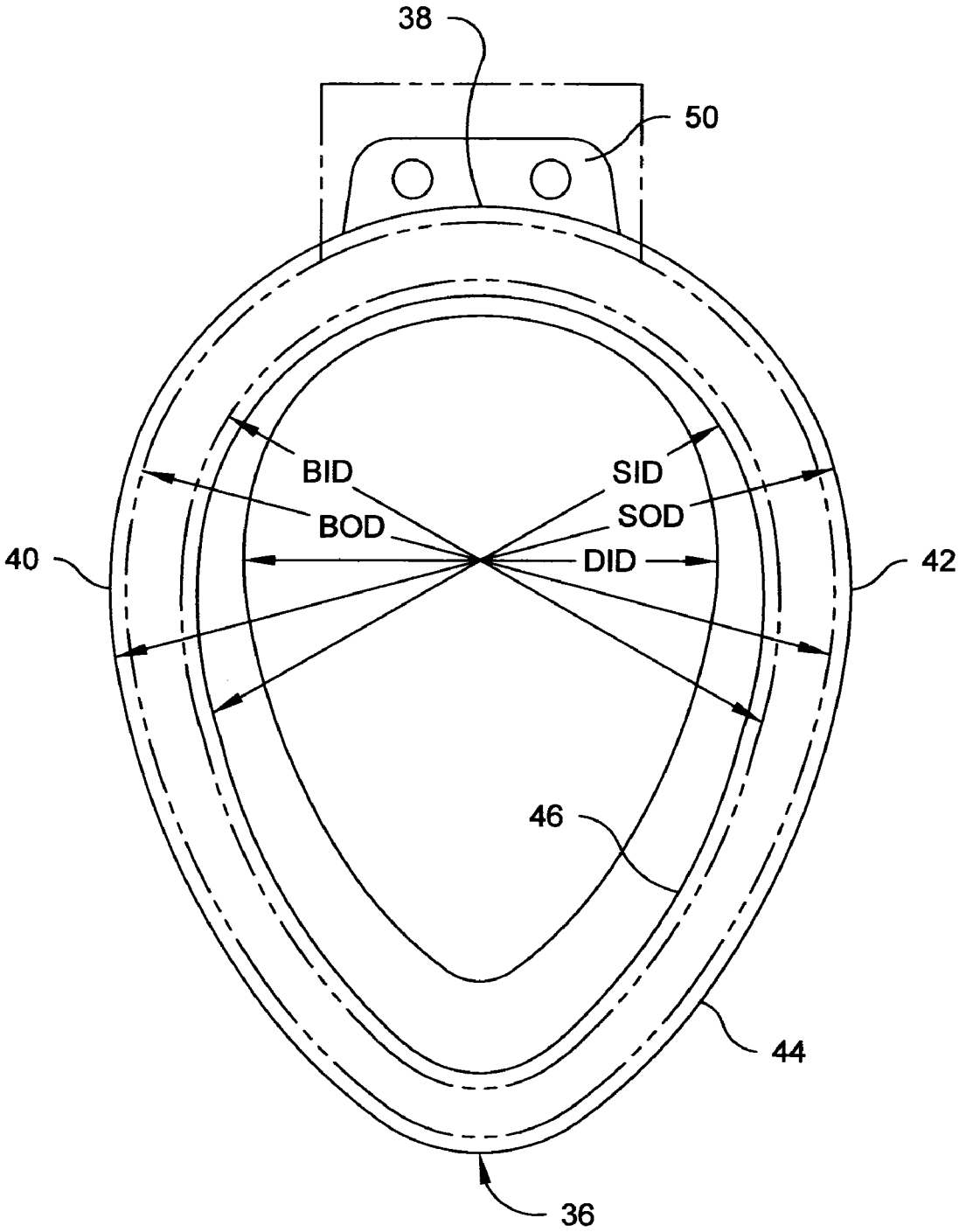
FIG. 4 is a top plan view of the toilet seat shown in FIG. 1.

A toilet seat in accordance with a first embodiment is illustrated in FIGS. 1-4 and is designated generally by reference numeral 10. The seat 10 is shown affixed to a Western-style toilet 12 having a tank 14, an elongate bowl 16, and a bowl rim 18. The rim 18 has a generally-flat top surface 20, an outside surface 22 and an inside surface 24 that projects downwardly into the bowl 16. Referring to FIGS. 2 and 4, the width of the bowl rim (BRW), depth of the bowl rim (BRD), bowl inner diameter (BID), and bowl outer diameter (BOD) may vary slightly but are generally uniform throughout the industry. While the toilet seat 10 is shown installed on a toilet having an elongate bowl, it should be appreciated by those of ordinary skill in the art that the novel toilet seat 10 can be used with a toilet having a round bowl without departing from the scope of the invention.

The toilet seat 10 has a generally-oval, endless base 30, which has a shape that compliments the shape of the rim 18 of the bowl 16. Referring to FIGS. 1-4, the base 30 has a top surface 32, bottom surface 34, front section 36, back section 38, opposed side sections 40, 42, an outer periphery 44 and an inner periphery 46. In a preferred embodiment, the diameter of the inner periphery 46 of the seat (SID) is equal to or smaller than the corresponding inner diameter of the bowl (BID). It is also preferred that the diameter of the outer periphery 44 of the seat (SOD) is equal to or larger than the corresponding outer diameter of the bowl (BOD).

The seat 10 is attached to the bowl 16 with a pair of hinges 50. As best seen in FIG. 3, the seat may have a pair of legs 252 fixed to the bottom of the base 30, which elevate the seat 10 relative to the top surface 20 of the bowl and form a gap G1 between the seat 10 and the rim 18.

To prevent urine from splashing, squirting, or leaking through the gap G1, a deflector 60 is fixed to the bottom surface 34 of the base 30. The deflector extends downwardly adjacent the inside surface 24 of the rim 18. In the embodiment shown in FIGS. 1-4, the deflector 60 is integrally formed with the seat base 30; however, it should be appreciated by those of ordinary skill in the art that the deflector 60 could be formed separately and connected to the seat base 30 as shown for example in FIG. 7.

Recognizing that urine will most likely splash, squirt or leak toward the front of the bowl, in a first embodiment the deflector 60 has a maximum depth at the front section 62 and tapers to a minimum depth 64 at the back section 38 as best seen in FIGS. 1 and 2. Referring to FIG. 2, the depth of the deflector 60 is great enough to cover the interior gap G1 along the front section 36 of the bowl and approximately halfway around the side sections 40, 42 of the bowl. Preferably, the depth of the deflector 60 is great enough along this section to extend below the bottom of the inside rim surface 24.

In a preferred embodiment, the width of the seat base 30 is greater than the bowl rim width (BRW) on the top surface 20. Further, the inner diameter of the seat (SID) is preferably less than the inner diameter of the bowl (BID) so that a gap G2 is formed between the deflector and the inside surface 24 of the rim so that the seat can be lifted upwardly and downwardly without the deflector 60 interfering with the rim 18. The deflector 60 may also protrude downwardly at a radially-inward angle as seen in FIGS. 2 and 3 to gradually enlargen the gap G2. The radially-inward angle offsets the bottom of the deflector 60 from the rim and ensures that fluid will drip into the bowl without wicking onto the rim. The radially-inward angle also ensures that the deflector 60 will not interfere with the rim 18 when the seat 10 is moved from the vertical position to the horizontal position. Alternatively, the deflector may protrude generally vertically downwardly parallel to the inside surface 24 of the rim 18.

In a preferred embodiment, the seat 10 and the deflector 60 are made from plastic or laminated wood. The seat 10 may be made by conventional processes such as molding.

Figure 5:
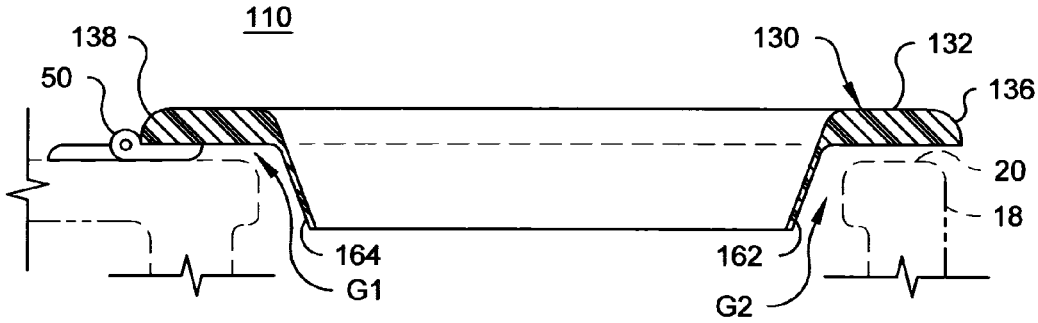
FIG. 5 is a sectional view of a toilet seat in accordance with a further embodiment of the invention.

Another embodiment of the seat in accordance with the invention is shown in FIG. 5 and is designated generally by reference numeral 110. The seat 110 has a construction generally similar to the seat 10 described above with respect to FIGS. 1-4; however, in this embodiment, the deflector 160 extends downwardly and around the entire periphery of the base 130. Further, the depth of the deflector 160 is constant along the entire periphery. In this embodiment, the deflector 160 covers the entire gap G1 between the seat and the rim, not just the gap at the forward portion of the bowl, thereby also preventing any rearwardly splashed, squirted or leaked fluid from soiling the rim and the hinges 50.

Figure 6:
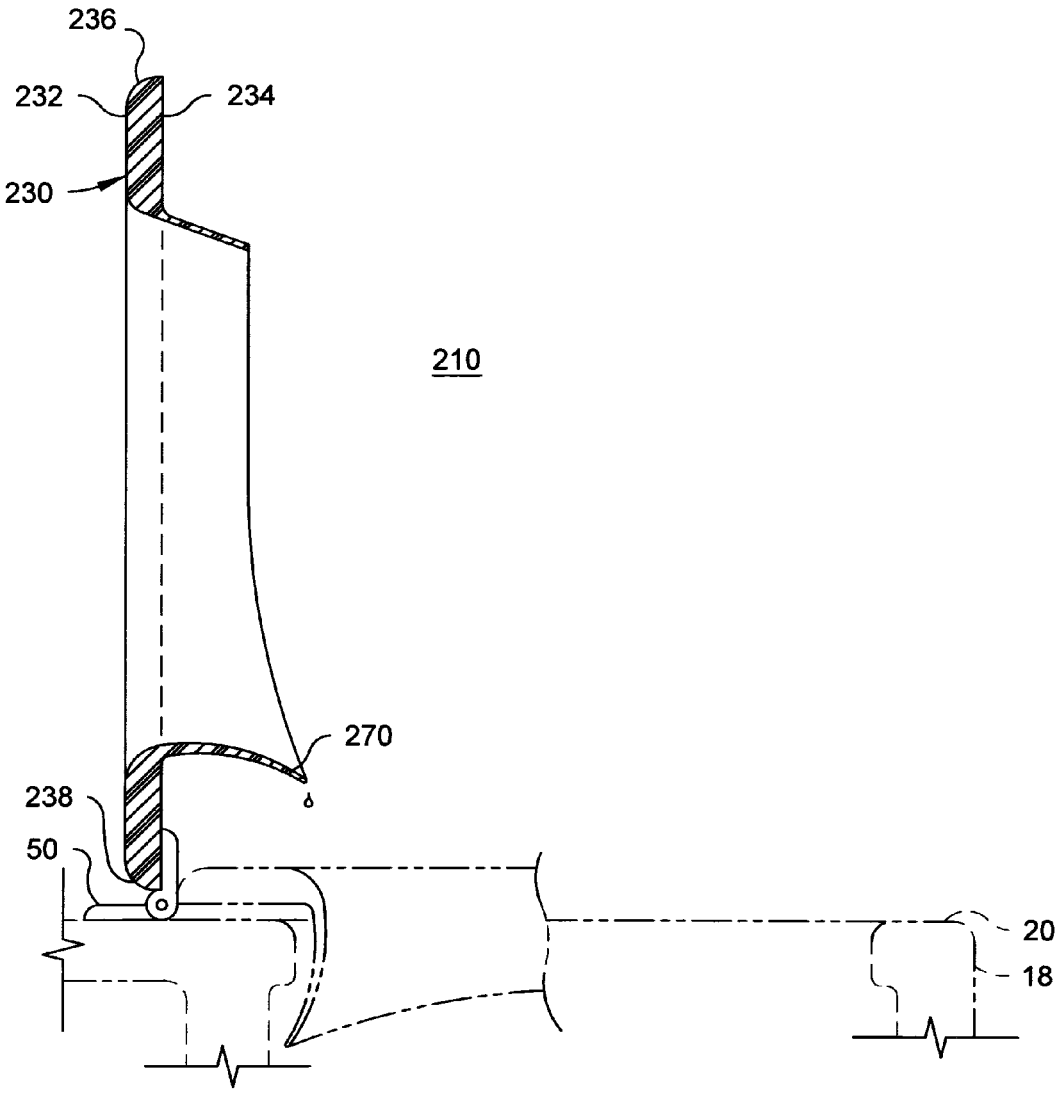
FIG. 6 is a sectional view of a toilet seat in accordance with an additional embodiment of the invention; and, FIG. 7 is a sectional view of a toilet seat in accordance with yet a further embodiment of the invention.

A further embodiment of the seat in accordance with the invention is shown in FIG. 6 and is designated generally by reference numeral 210. The seat 210 has a construction similar to the seat 110 described above with respect to FIG. 5; however, in this embodiment, the deflector 260 includes a spout 270 formed proximate the back section 238 of the deflector 260. When the seat is in the horizontal position, the spout 270 extends downwardly into the bowl and radially outwardly. When the seat is in the vertical position, the spout 270 extends radially inwardly farther than the inside edge of the bowl rim. In this embodiment, when the seat is lifted to the vertical position, any fluid that has collected on the deflector runs down and drains into the bowl instead of pooling at the bottom of the deflector.

Figure 7:
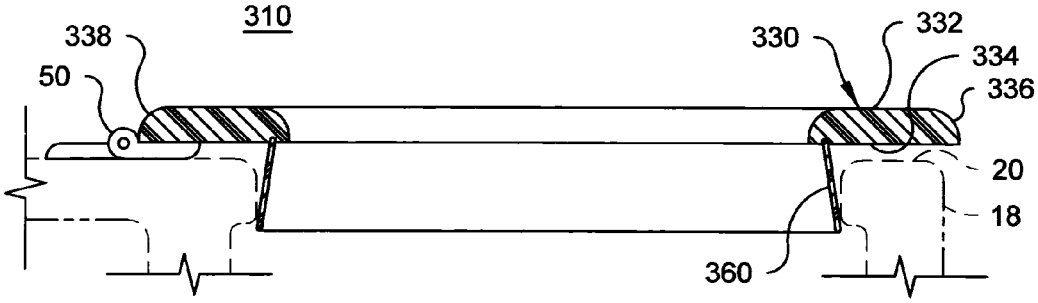

An additional embodiment of the seat in accordance with the invention is shown in FIG. 7 and is designated generally by reference numeral 310. The seat 310 has a construction generally similar to the seat 10 described above with respect to FIGS. 1-4; however, in this embodiment, the deflector 360 is not integrally formed with the base 330. Instead, the deflector 360 is attached to the bottom surface 334 of the base intermediate the inner and outer base peripheries. The deflector may be adhered, fixed using conventional fasteners, or connected via a tongue and groove construction.

Further, in this embodiment, the deflector may extend vertically, radially inwardly as disclosed in FIGS. 1-6, or radially outwardly such as shown in FIG. 7. By projecting radially outwardly, any urine or water splashed upwardly from the bowl will not contact the back side 366 of the deflector and become entrapped between the back side 366 and the inside surface 24 of the bowl rim 18.

In this embodiment, the deflector 360 and seat 310 may be made from different materials. For example, deflector 360 may be made from a more flexible material or even a thin, pliable sheet that drapes over or bends around the rim.

While the principles of the invention have been described above in connection with specific embodiments, it is to be clearly understood that this description is made only by way of example and not as a limitation on the scope of the invention. For example, the structural features of the numerous embodiments described can be interchanged in many ways to provide additional embodiments. Those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

The invention claimed is:

1. A toilet seat for use with a toilet bowl having a bowl rim (18) with front and back sections and a width (BRW) to define a top surface (20) and an inside surface (24), comprising:

a) a base that generally conforms to and compliments the shape of said bowl rim, said base having a top surface, bottom surface, opposed base front and back sections that are generally coextensive with said bowl rim front and back sections, respectively, when said base is in a lowered generally horizontal position;

b) an annular deflector integrally formed on the bottom surface of said base and extending downwardly adjacent the inside surface of the bowl rim, said deflector covering an interior gap between the bottom surface of said base and the top surface of the bowl rim, a portion of the deflector proximate the back section of the base extending downwardly and radially outwardly and a portion of the deflector proximate the front section of the base extending downwardly and radially inwardly when said base rests on the bowl rim in the lowered position of said base and the portion of the deflector proximate the back section of the base forming a spout that extends above the top surface of the bowl rim and radially inwardly past the bowl rim in an elevated substantially vertical position of said base, whereby any fluid accumulation on said deflector drains off said spout radially inwardly of said bowl rim and said inside surface and avoids dripping on said bowl rim top surface.

2. The toilet seat recited in claim 1, wherein said deflector extends downwardly around the entire periphery of said base and the depth of the deflector is constant along said periphery.

3. The toilet seat recited in claim 2, wherein the depth of the deflector is great enough so that said deflector extends downwardly below the bottom of the bowl rim.

4. The toilet seat recited in claim 1, wherein the deflector has a maximum depth at the front section and tapers to a minimum height at the back section.

5. The toilet seat recited in claim 4, wherein the depth of at least a portion of the deflector is great enough so that said deflector portion extends downwardly below the bottom of the bowl rim.

6. The toilet seat recited in claim 1, wherein said base has a width greater than BRW.

7. The toilet seat recited in claim 1, wherein said deflector extends downwardly and radially inwardly at said base front section when said base is in a lowered position supported by the bowl rim .

8. The toilet scat recited in claim 1, wherein said deflector at said base back section has a linear cross-section.

9. The toilet seat recited in claim 1, wherein said deflector at said back section has a curved cross-section.

10. The toilet seat recited in claim 1, including a hinge at the back sections of the said bowl rim and said base for pivotally attaching said base to the bowl, and a plurality of legs on the bottom surface of said seat.

11. A toilet seat for use with a toilet bowl including a bowl rim having an inner edge and an outer edge and a toilet seat attachment area located rearward of the bowl rim, the toilet seat comprising:

a) an annular base having a back portion that is adapted to be secured to the toilet seat attachment and a top surface, a bottom surface having a plurality of legs extending downwardly therefrom, opposed front and back sections, opposed side sections, an outer periphery, and an inner periphery, said base being shaped to overlap the bowl rim, the inner periphery being located inward of the inner edge of the bowl rim, and the plurality of legs being sized to maintain an interior gap between the bottom surface and the bowl rim when the rear portion is secured to the toilet seat attachment area and the base is positioned atop the bowl rim;

b) a hinge connecting said base to the back portion to the bowl and enables said base to pivot relative to the bowl; and c) a deflector intearally formed on the bottom surface of said base and extending generally downwardly therefrom, the deflector being located adjacent to the inner edge of the bowl rim and covering the interior gap when the rear portion is secured to the toilet seat attachment area and the base is positioned atop the bowl rim, a portion of the deflector proximate the back section of the base extending downwardly and radially outwardly and a portion of the deflector proximate the front section of the base extending downwardly and radially inwardly when said base rests on the bowl rim in the lowered position of said base and the portion of the deflector proximate the back section of the base forming a spout that extends above the top surface of the bowl rim and radially inwardly past the bowl rim in an elevated substantially vertical position of said base, whereby any fluid accumulation on said deflector drains off said spout radially inwardly of said bowl rim and said inside surface and avoids dripping on said bowl rim top surface.

* * * * *